US006883838B1

(12) United States Patent
Horton

(10) Patent No.: US 6,883,838 B1
(45) Date of Patent: Apr. 26, 2005

(54) LOCKING NECKED BARREL BOLT APPARATUS

(76) Inventor: Edward Anthony Clive Horton, 9 Oak Close - Southgate, London (GB), N14 5NR ( * ) Notice: Subject to any disclaimer, the term of this patent is extended or adjusted under 35 U.S.C. 154(b) by 0 days.

(21) Appl. No.: 10/342,524

(22) Filed: Jan. 16, 2003

(51) Int. Cl.[7] ..... E05C 5/02

(52) U.S. Cl. ..... 292/57; 292/42; 292/67; 292/71; 292/145; 292/DIG. 30

(58) Field of Search ..... 292/DIG. 30, 57, 292/42, 67, 71, 145

(56) References Cited

U.S. PATENT DOCUMENTS

| | | | | | |
|---|---|---|---|---|---|
| 831,235 | A | | 9/1906 | Nash | |
| 854,193 | A | * | 5/1907 | Betts | 292/189 |
| 988,455 | A | * | 4/1911 | Gee | 292/189 |
| 1,294,462 | A | * | 2/1919 | Herlihy | 292/57 |
| 1,355,371 | A | * | 10/1920 | Welsh | 292/57 |
| 3,174,314 | A | * | 3/1965 | Johnson | 70/77 |
| 3,752,518 | A | * | 8/1973 | Cannell | 292/42 |
| 3,906,759 | A | * | 9/1975 | Schwing et al. | 70/128 |
| 4,214,783 | A | * | 7/1980 | Boegeman | 292/150 |
| 4,286,810 | A | * | 9/1981 | Ehmen | 292/67 |
| 4,405,112 | A | | 9/1983 | Doubleday | |
| 4,512,105 | A | * | 4/1985 | Norton | 49/394 |
| 4,606,566 | A | * | 8/1986 | Bott | 292/57 |
| 4,790,578 | A | * | 12/1988 | Barrera | 292/148 |
| 4,858,972 | A | * | 8/1989 | Salyer | 292/338 |
| 4,911,486 | A | | 3/1990 | Anderson | |
| 4,921,287 | A | * | 5/1990 | Horvath et al. | 292/106 |
| 5,110,164 | A | * | 5/1992 | Whiteman et al. | 292/4 |
| 5,110,166 | A | | 5/1992 | Brown | |
| D329,800 | S | | 9/1992 | Pearson | |
| D329,801 | S | | 9/1992 | Pearson | |
| D344,882 | S | | 3/1994 | Doyle | |
| D353,317 | S | | 12/1994 | Abruzzo | |
| 5,398,982 | A | * | 3/1995 | Watson, Jr. | 292/259 R |
| 6,102,452 | A | * | 8/2000 | Liau | 292/175 |
| 6,655,720 | B2 | * | 12/2003 | Rampen | 292/61 |

FOREIGN PATENT DOCUMENTS

| | | |
|---|---|---|
| FR | 2609097 | * 12/1986 |

* cited by examiner

*Primary Examiner*—Daniel P. Stodola
*Assistant Examiner*—Carlos Lugo
(74) *Attorney, Agent, or Firm*—Richard L. Mikesell

(57) ABSTRACT

A locking necked barrel bolt apparatus includes an attachment plate having a hollow barrel body attached to an upper surface thereof. A neck bolt having first and second sections rotatably connected to one another is slidably disposed within the barrel body. The first section has a handle extending therefrom and the second section has an angled portion configured to be inserted into an aperture of a locking plate. The handle of the first section is capable of being turned into a locking notch of the apparatus to secondarily lock the apparatus and prevent the bolt from unwantingly being removed from the locking plate.

5 Claims, 1 Drawing Sheet

FIG. 1
PRIOR ART
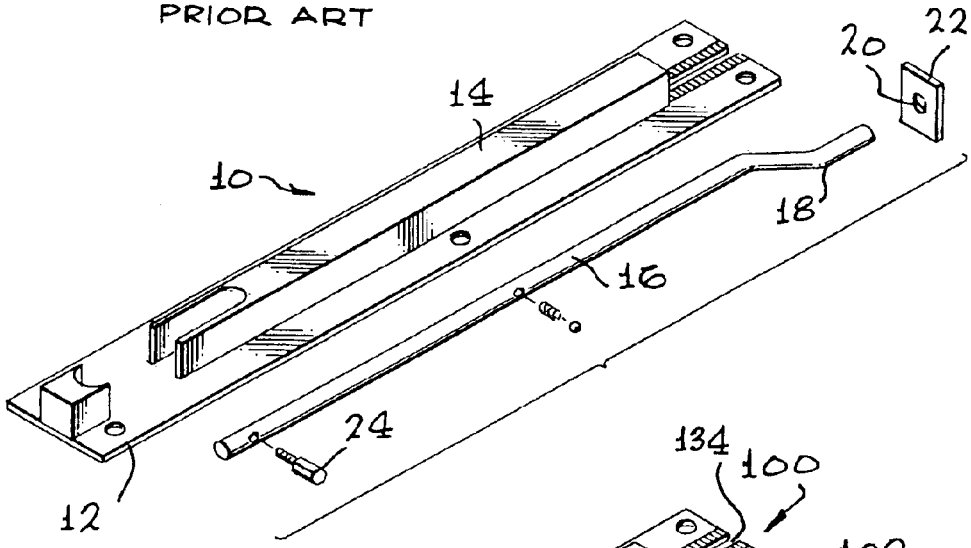
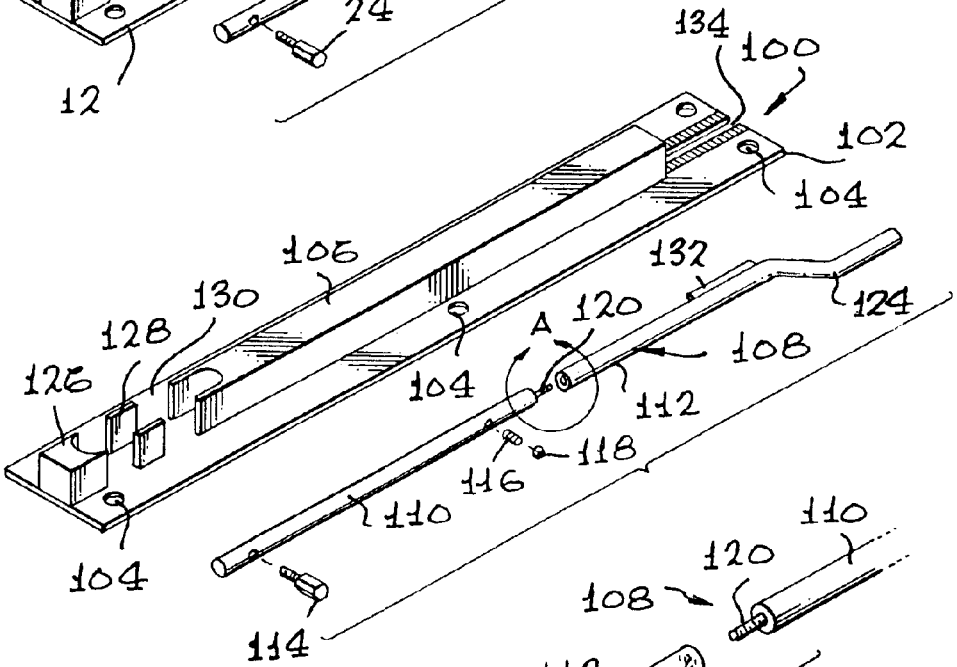
FIG. 2
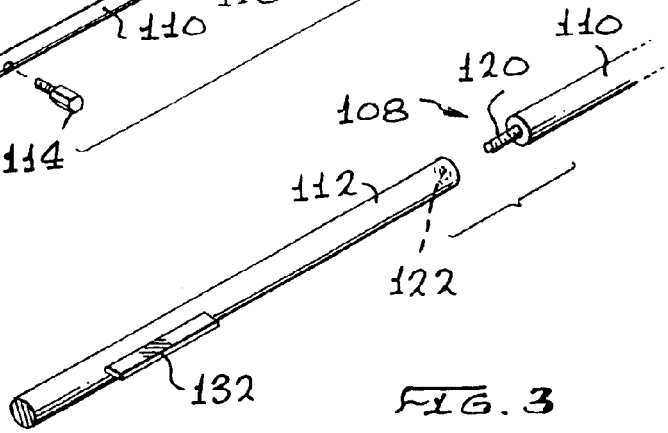
FIG. 3

LOCKING NECKED BARREL BOLT APPARATUS

BACKGROUND OF THE INVENTION

The present invention generally resides in locks and the like. More particularly, the present invention resides in a locking necked barrel bolt apparatus having a receiving keep or stop to prevent inadvertent or forced unlocking thereof.

For quite sometime there have existed straight bolt locks and necked bolt locks. Such are often used in locking gates in outdoor settings. Also, such locks are often used in the case where the door opens outwards, such as in the instance of a small toilet or bathroom where a door opening into the room would take up too much space, as well as doors that open onto a balcony or garden. Such doors often utilize a "cranked" or "necked" bolt to serve either as a primary or secondary means of locking the door.

In the case of a typical straight bolt lock, a straight bolt slidable through a body is attached to the door or gate. The bolt can be retracted so that the door can be opened. Upon extending the bolt through a lock plate or catch, the door is locked. In such straight bolts, a small handle or extension protrudes generally transverse to the straight bolt so as to be inserted into a keep or locking notch so that the bolt cannot be removed from the locked plate or catch until it is intentionally removed from the notch and withdrawn. This is done by turning the bolt a quarter turn to remove it from the locking notch and sliding it away from the lock plate or catch. Such arrangement is very desirable as it does not allow forced entry through the door as readily, and can be used in vertical situations, such as placing the lock at the top of a door and frame.

However, there are instances where straight bolt locks are not viable as the door stop or frame does not lie flush with the door itself. In such instances, with reference to FIG. 1 which illustrates a prior art necked bolt, a necked bolt lock 10 is used. Such a lock 10 includes an attachment plate 12 for securing the lock 10 to a door, a hollow barrel body 14 through which slides the necked bolt 16. As will be seen in FIG. 1, the bolt 16 includes an angled end 18 which is inserted through an aperture 20 of a lock plate 22, or catch, attached to the door stop or door frame. A screw-in handle 24 enables the bolt 16 to be slid into and out of the lock plate to lock and unlock the door.

However, due to the fact that the bolt 16 includes an angled or raised portion 18, the bolt 16 itself cannot be turned a quarter turn to secondarily lock it into a locking notch or keep. Thus, such locks can become inadvertently unlocked when used at the top of a door as the bolt 16 may merely slide out of the lock plate 22 due to gravity, or forced entry.

Accordingly, there is a continuing need for a necked barrel bolt lock which is capable of being secondarily locked similar to a straight bolt lock. The present invention fulfills these needs and provides other related advantages.

SUMMARY OF THE INVENTION

The present invention resides in a locking necked barrel bolt apparatus comprised of an attachment plate and a hollow barrel body attached to an upper surface of the attachment plate. A neck bolt is slidably disposed within the barrel body. The bolt has first and second sections which are rotatably connected to one another. Typically, the first section includes an externally threaded post extending from an end thereof, and the second section includes an internally threaded end which receive the threaded post. The second section has an angled portion configured to be inserted into an aperture of a locking plate or the like.

A locking notch is formed on the top surface of the attachment plate. For example, the locking notch may be formed by spaced relation between an end of the barrel body and post extending upwardly from the attachment plate. Thus, the apparatus is locked upon sliding the neck bolt such that the angled portion is inserted into the locking plate aperture. By turning the handle into the locking notch, the second section rotates relative to the first section and secondarily locks the lock.

The second section may include a stop for limiting the rotation thereof, such as a fin extending from the second section which is slidably received within a groove of the attachment plate or hollow body. This enables the first section to be rotated a quarter turn in a much easier fashion.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a partially exploded perspective view of a prior art necked barreled bolt lock;

FIG. 2 is a partially exploded perspective view of a necked barrel bolt locking apparatus embodying the present invention; and FIG. 3 is an enlarged perspective view of area "A", illustrating the threaded connection between first and second sections of a bolt of the apparatus.

DETAILED DESCRIPTION OF THE PREFERRED EMBODIMENT

As shown in the accompanying drawings for purposes of illustration, the present invention resides in a locking necked barrel bolt apparatus, generally referred to by the reference number 100. The apparatus 100, as shown in FIG. 2, includes an attachment plate 102 having a plurality of apertures 104 configured to receive screws or the like in order to attach the attachment plate 102 to a door surface. A hollow barrel body 106 extends from an upper surface of the attachment plate 102 and is configured to receive a necked barreled bolt 108.

The necked barrel bolt 108 includes first and second sections 110 and 112 which are rotatably connected to one another. The first section 110 is generally straight. It includes a handle 114 extending generally transverse to a longitudinal axis thereof. The handle 114 may be threadably inserted into an end of the first section 110, as illustrated. The first section 110 also includes a spring 116 and ball bearing 118 which facilitate the slidable movement within the barrel body 106. The end of the first section 110 generally opposite the handle 114 includes a externally threaded post 120. A first end of the second section 112 includes an internally threaded aperture 122 which receives the threaded post 120. A second and opposite end 124 of the second section 112 is angled, as described above, so as to be inserted into an aperture of a locking plate or the like.

With continuing reference to FIG. 2, a stop 126 is formed at an end of the attachment plate 102 to prevent the sliding movement of the bolt 108 in an open and unlocked state. Posts or the like 128 extend upwardly between the stop 126 and the hollow body 106 so as to form a locking notch 130, or keep, into which the handle 114 can be inserted. In use, the handle 114 is grasped by the user and pushed away from the stop 126 such that end 124 is inserted into the aperture of the locking plate or catch. The handle 114 is then turned one-quarter turn into locking notch 130. The locking bolt 108 of the present invention is able to do this due to the rotatable connection of the first and second sections 110 and 112.

The second section 112 may include a stop, such as the illustrated fin 132 which is slidably received within a notch or groove 134 of the attachment plate 102 or body 106. In this manner, as the handle 114 is turned, causing the first section 110 to twist and rotate with respect to the second section 112, the second section 112 is held in place by the stop or fin 132. When desiring to unlock the apparatus 100, the handle 114 is lifted upwardly so as to be in alignment with the hollow body 106, and the bolt 108 is pulled towards stop 126 such that end 124 is removed from the locked plate or catch, enabling the door to be opened.

Although several embodiments have been described in some detail for purposes of illustration, various modifications may be made without departing from the scope and spirit of the invention. Accordingly, the invention is not to be limited, except as by the appended claims.

What is claimed is:

1. A locking necked barrel bolt apparatus comprising:

an attachment plate;

a hollow barrel body attached to an upper surface of the attachment plate;

a neck bolt slidably disposed within the barrel body, and having first and second sections rotatably connected to one another, the first section having a handle extending therefrom, and the second section having an angled portion configured to be inserted into an aperture of a locking plate, the second section including a stop for limiting the rotation thereof, the stop including a fin extending from the second section and slidably received within a groove defined in the attachment plate for limiting rotation of the second section, and a locking notch formed on the top surface of the attachment plate, whereby the apparatus is locked upon sliding the neck bolt such that the angled portion is inserted into the locking plate aperture, and turning the handle into the locking notch, causing the second section to rotate relative to the first section.

2. The apparatus of claim 1, wherein the first section includes an externally threaded post extending from an end thereof and received within an internally threaded end of the second section.

3. The apparatus of claim 1, wherein the locking notch is formed by spaced relation between an end of the barrel body and posts extending upwardly from the attachment plate.

4. A locking necked barrel bolt apparatus comprising:

an attachment plate;

a hollow barrel body attached to an upper surface of the attachment plate;

a post extending upwardly from the attachment plate and spaced from an end of the barrel body to form a locking notch therebetween;

a neck bolt slidably disposed within the barrel body, and having first and second sections rotatably connected to one another, the first section having a handle extending therefrom, and the second section having an angled portion configured to be inserted into an aperture of a locking plate; and a stop formed on the second section, the stop including a fin extending from the second section and slidably received within a groove defined in the attachment plate for limiting rotation of the second section, whereby the apparatus is locked upon sliding the neck bolt such that the angled portion is inserted into the locking plate aperture, and turning the handle into the locking notch, causing the second section to rotate relative to the first section.

5. The apparatus of claim 4, wherein the fist section includes an externally threaded post extending from an end thereof and received within an internally threaded end of the second section.

* * * * *